United States Patent [19]

Singer et al.

[11] 4,205,931

[45] Jun. 3, 1980

[54] PNEUMATIC ASH TRANSPORTING AND CONTAINING SYSTEM

[75] Inventors: Joseph G. Singer, Bloomfield; Harold E. Collins, Enfield, both of Conn.

[73] Assignee: Combustion Engineering, Inc., Windsor, Conn.

[21] Appl. No.: 966,402

[22] Filed: Dec. 4, 1978

[51] Int. Cl.[2] ..... B65G 53/28; B65G 53/60

[52] U.S. Cl. ..... 406/109; 55/311; 55/431; 55/468; 110/216; 406/169; 406/175

[58] Field of Search ..... 406/109, 168, 169, 175; 55/311, 431, 466, 468; 110/216

[56] References Cited

U.S. PATENT DOCUMENTS 3,742,874 7/1973 Eff ..... 110/216 X

FOREIGN PATENT DOCUMENTS 1277120 9/1968 Fed. Rep. of Germany ..... 406/109

*Primary Examiner*—Jeffrey V. Nase

*Attorney, Agent, or Firm*—Robert L. Olson

[57] ABSTRACT

Apparatus including an enclosed pressurized conveying and storage system that will allow potentially explosive flyash or other fine material to be handled with the minimum possibility of damage to the equipment in the event of an explosion. The steel storage vessel is maintained under slight pressure with inert gases by means of a pressure relief valve and an inert gas supply, and is kept at a high enough temperature to prevent condensation of the gas (so that corrosive acids are not formed) by electric inductance heaters and insulation. Airlock valves are used to allow the ash into and out of the transport and containment system.

4 Claims, 1 Drawing Figure

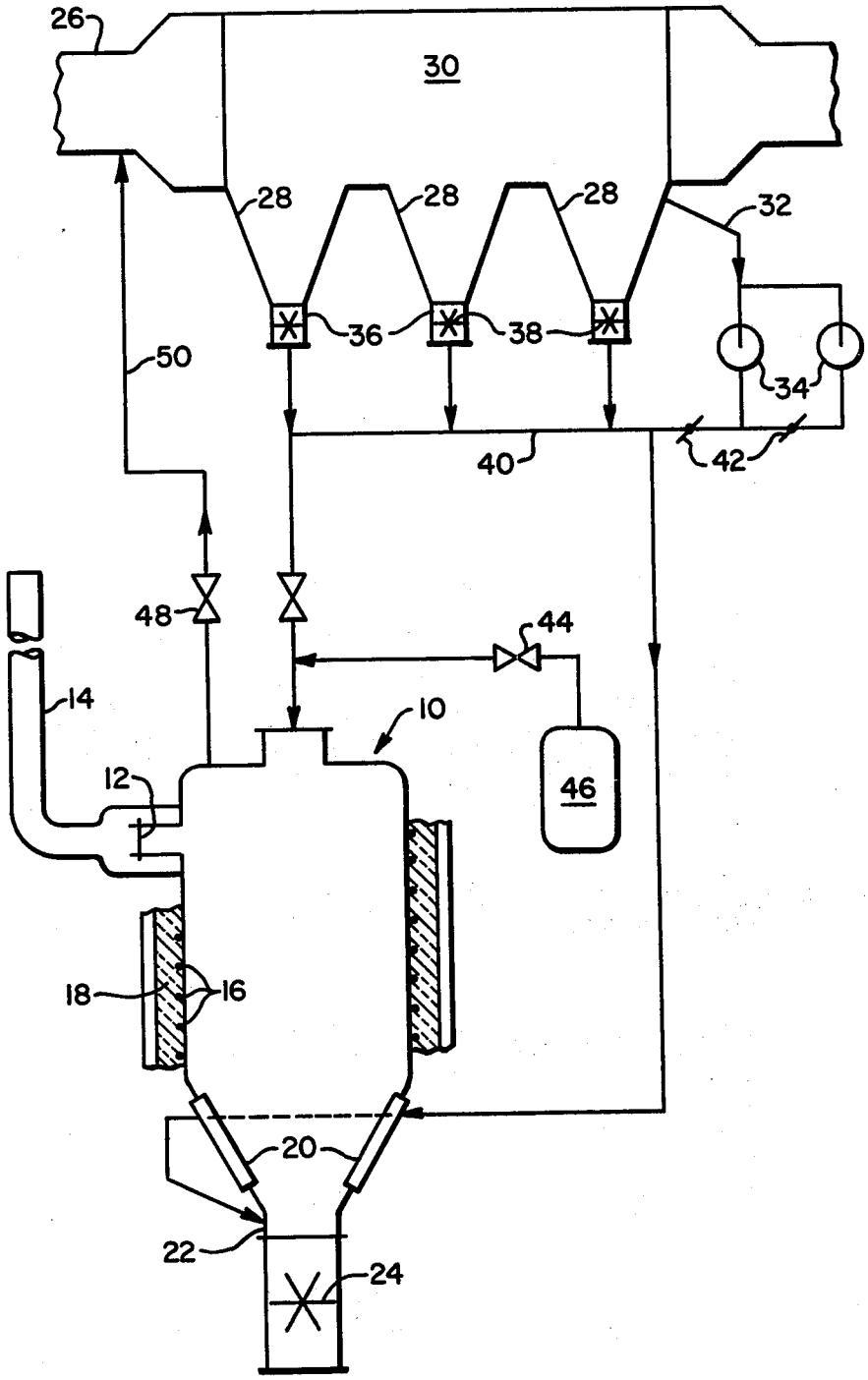
26
30
28
28
28
32
36
38
34
50
40
42
48
44
14
10
12
46
18
16
20
22
24

PNEUMATIC ASH TRANSPORTING AND CONTAINING SYSTEM

BACKGROUND OF THE INVENTION

Dust explosions are a hazard to be reckoned with wherever there is an accumulation of fine particles in a partially closed area, where small amounts of oxygen are present. Elevated temperatures add to the problem. One such area is the flyash silo at the tail end of a solid-fuel-fired boiler, where the fine ash particles are allowed to settle out of the combustion gases leaving the boiler.

SUMMARY OF THE INVENTION

In accordance with the invention, apparatus is provided, including an enclosed pressurized conveying and storage system that will allow potentially explosive flyash to be handled with the minimum possibility of damage to the equipment. The storage tank or vessel is maintained under inert gas, under slightly pressurized conditions by means of an inert gas source and pressure relief valves. An elevated temperature is also maintained in the storage tank to prevent formation of corrosive acids. Airlocks are used to introduce and withdraw the flyash from the system.

BRIEF DESCRIPTION OF THE DRAWING

The FIGURE is a schematic of a conveying and storage system for flyash constructed in accordance with the invention.

DESCRIPTION OF THE PREFERRED EMBODIMENT

Looking now to the FIGURE, numeral 10 designates a steel vessel designed for an elevated pressure, such as 5 psig, to receive and contain flyash, or other potentially explosive fine materials. The elevated design pressure is for the purpose of allowing moderate excursions in system operating pressure, or "puff" (low-pressure-level explosions) without resulting in a discharge of the material to atmosphere.

The vessel or tank 10 is provided with a pressure-actuated mechanical relief device 12 to prevent failure of the tank in the event of a high-pressure explosion. The relief device 12 is in an outlet pipe 14 which extends high enough to prevent the discharge of material in any area where operating personnel can be affected.

The tank 10 is kept at a temperature of approximately 300° F. by means of a heating device, such as an inductance heating coil 16, such that no condensation of the conveying gases take place, which could result in the formation of corrosive acids in the tank 10. The heat in the tank is retained by a layer of insulation 18, which completely encompasses the tank 10.

The tank 10 can be provided with fluidizing means in the form of perforated plates 20, through which inert gas in introduced, to cause the accumulated flyash to flow freely through discharge opening 22 when the tank is being emptied.

The outlet 22 contains a flap-type or rotary airlock 24, to allow the flyash to be discharged while preventing air from entering and the gases within the tank from escaping.

The equipment for collecting the fine flyash from the combustion gases flowing in duct 26 includes a series of ash hoppers 28, located in a mechanical or electrostatic dust collector 30. The gas flowing through duct 26 is usually at a partial vacuum. The ash conveying system includes pipe 32, containing fans 34 for pressurizing they conveying system. The outlets 36 from the ash hoppers each contain a rotary airlock 38 for separating the two differential pressure flow systems while permitting the ash to be discharged into pipe 40. Dampers 42 are used to close the piping when the fans 34 are not in operation, preventing reverse flow therethrough.

Control valve 44 keeps the storage tank 10 within a given pressure range, for example one to fifteen inches water gage. A source 46 of pressurized inert gas, such as nitrogen or carbon dioxide, maintains the positive pressure. A spring-loaded pressure relief valve 48 is set to relieve pressure when it exceeds the desired given range. The piping 50 containing this valve can direct the gases back to the duct 26 upstream of the dust collector 30.

What is claimed is:

1. A conveying and storage system for handling potentially explosive fines including a duct in which combustion-produced inert gases carrying the fines is flowing, means for separating the fines from the gases, a storage tank, pipe means extending between the separating means and tank, fan means in said pipe means for causing the fines to move to the tank at a positive pressure, means for allowing discharge of the fines from the separating means to the pipe means while preventing any substantial gas flow therebetween, means for supplying inert gas to the tank for maintaining the tank at a positive pressure when combustion-produced inert gas is not available, and pressure relief means for allowing gases to escape from the storage tank in the event of an abrupt pressure increase.

2. The system as set forth in claim 1, wherein the fines are flyash discharged from a boiler.

3. The system as set forth in claim 2, including a bottom opening in the tank, and means for allowing the flyash to be discharged therefrom while preventing any substantial gas flow therethrough while the flyash is being discharged.

4. The system as set forth in claim 3, including means for fluidizing the flyash in the tank to assist in its discharge therefrom.

* * * * *